United States Patent [19]

Stricker et al.

[11] Patent Number: 4,783,884

[45] Date of Patent: Nov. 15, 1988

[54] KNOB

[75] Inventors: David K. Stricker, Juneau; John B. Kuhn, Rubicon; Virgil P. Huhmann, Beaver Dam; William E. Chase, Colgate, all of Wis.

[73] Assignee: Deere & Company, Moline, Ill.

[21] Appl. No.: 3,332

[22] Filed: Jan. 13, 1987

[51] Int. Cl.[4] ..... B25G 1/00

[52] U.S. Cl. ..... 16/114 R; 16/121

[58] Field of Search ..... 16/121, 122, 123, 114 R, 16/118, DIG. 30; 403/329, 326, 330; 74/545, 553, 557

[56] References Cited

U.S. PATENT DOCUMENTS 3,372,950 3/1968 Wind ..... 74/553

4,224,786 9/1980 Langlie et al. ..... 403/361

FOREIGN PATENT DOCUMENTS 1535032 12/1978 United Kingdom ..... 403/361

*Primary Examiner*—M. Jordan

*Assistant Examiner*—Edward A. Brown

[57] ABSTRACT

An improved knob for attachment to a lever or the like having a knob body with a cavity formed therein, an extension operatively attached to the body and being biased toward the cavity. Operatively attached to the extension is a projection for engaging a mating portion on the lever and a tapered portion for enabling the knob to be easily removed from the lever. The preferred knob has the extension connected to the knob body so that the extension does not project very far below the cavity entrance. The knob of the present invention is preferably manufactured by injection molding in a single step operation. Once cured, the knob is removed from the mold in condition for assembly on an appropriate lever or the like. To effectuate assembly, an assembler simply places the knob on the lever or the like until the projection engages a mating portion thereof.

22 Claims, 7 Drawing Sheets

KNOB

BACKGROUND OF THE INVENTION

The present invention relates to knobs and more particularly to control knobs which are attached to vehicle actuating levers.

There are essentially three types of knobs presently available for attachment to vehicle actuating levers. The first type is the conventional friction fit knob which is force assembled over the end of an actuating lever so that a friction fit between the internal surface of the knob and the external surface of the lever maintains the knob in position on the lever. While friction fit knobs are easily manufactured, they have proven difficult to remove and to service. Additionally, after a period of time, they loose the snugness of their original fit, and thus become too easily removable.

The second type is the conventional screw on knob, as illustrated in FIG. 2 of the drawings. Screw on knobs require multiple components, i.e. a knob body having a female insert mounted therein for receiving a male screw member usually machined on the end of the actuating lever receiving the control knob. Both the female insert and the actuating lever end must be precisely machined to provide for mating the male screw portion with female insert. These additional components and manufacturing steps make the cost of the screw on knob prohibitive despite its relative reliability and acceptable serviceability.

The final type is a conventional knob having mechanical fasteners such as set screws. This knob, as with the screw on knob, requires multiple components and precise manufacturing methods. Additionally, when using a set screw, at least one additional tool is required when servicing the knob in order to remove the knob from the actuating lever. Finally, as with the screw on knob, despite its relative reliability the mechanical fasteners type knob is also prohibitively expensive to manufacture and is relatively less serviceable due to the additional tool required.

Accordingly, there is a need for an improved knob for attachment to actuating levers which is easily and economically manufactured, which has a one-piece construction, is easily selectively attachable to and detachable from the actuating lever, which provides for a secure connection to the actuating lever, which requires no additional tools to attach or detach it from the actuating lever, and which does not require precise machining of any component including the actuating lever in order for the knob to be securely attached thereto.

SUMMARY OF THE INVENTION

The present invention is an improved knob construction for attachment to an actuating lever. The control knob of the present invention is manufactured at extremely low cost by a one piece injection molding process. No additional components such as inserts are required to be assembled to the knob and no special tools are required to assemble or disassemble the knob from the actuating lever.

Specifically, the preferred embodiment of the present invention comprises a one piece molded knob body having a cavity formed therein and an extension formed thereon. A projection is formed on an extension for engaging the actuating lever to secure the knob thereto. When the knob is installed on the lever, the projection is received by a mating portion formed in the lever. The connection formed by the mating portion and the projection prevents the knob from becoming easily detached from the lever. The extension having the projection is resiliently connected to the knob body such that the extension is constantly biased toward the cavity. In order to overcome the bias and to break the mating contact between the mating portion and the projection during disassembly of the knob from the lever, a positive force is required. Removal of the knob from the lever is facilitated by a tapered portion extending from the projection to the end of the extension.

An alternate embodiment of each knob is also disclosed. The principle differences between the two embodiments is the location on the knob body where the extension is connected thereto. In the preferred embodiment, the extension is connected to the knob body such that the end of the extension projects at most only slightly below the entrance to the cavity.

The primary objective of the present invention, therefore, is to provide an improved knob which is economically manufactured; which provides for secure attachment to a lever; which is easily detachable from the lever; which requires no special tools in order to attach or detach the knob to or from the lever; which is easily assembled to a lever; and which does not require precise machining of any component including the lever in order to securely yet detachably mount the knob thereon.

Other objects and advantages of the invention will be apparent from the following description, accompanying drawings and the appended claims.

DESCRIPTION OF THE PREFERRED EMBODIMENTS

Figure 1:
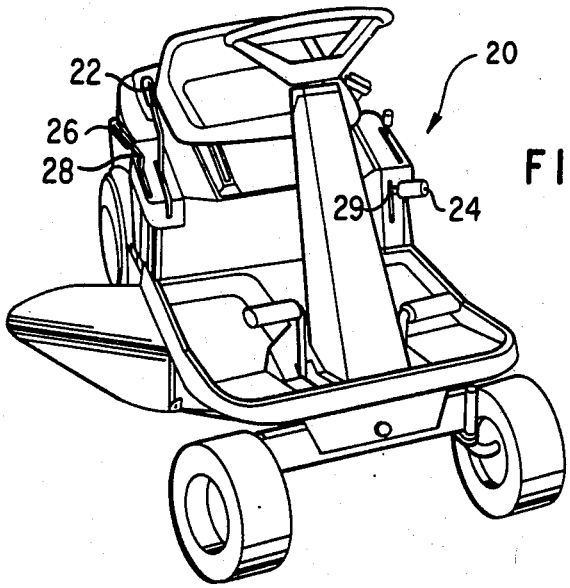
FIG. 1 is a isometric view illustrating a small off-road vehicle utilizing the knobs of the present invention.

FIG. 1 shows a riding mower 20 with a plurality of knobs 22, 24, and 26 of the present invention mounted to various actuating levers 28. Each of the knobs 22, 24 and 26 is shown as being mounted on an actuating lever in order to accomplish a particular function associated with the riding mower such as the lever for selecting the transmission mode and/or speed, positioning the attached mower deck, engaging or disengaging a PTO or other function normally provided on a riding mower.

Figure 2:
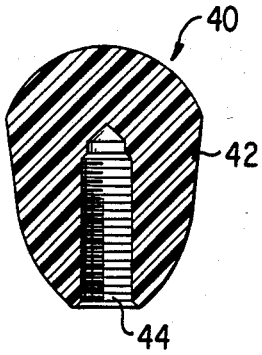
FIG. 2 PRIOR ART
FIG. 2 is a cross sectional side view of a prior screw on knob.
Figure 3:
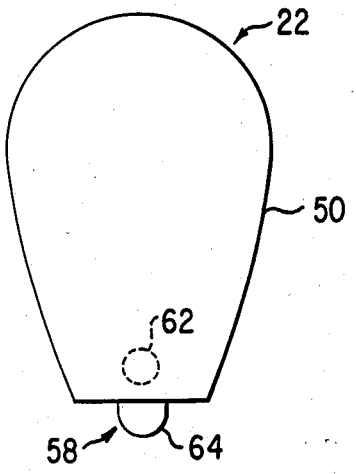
FIG. 3 is a side view of the preferred embodiment of a speed control knob.
Figure 23:
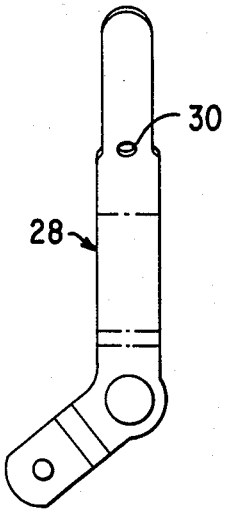
FIG. 23 is a side view of a representative actuating lever upon which the knobs of FIGS. 3–22 may be mounted.

FIG. 2 illustrates a prior screw on knob 40. The knob 40 consists of two components, the knob body 42 and a female insert 44 which is threaded to receive a male threaded portion (not shown) on the end of an actuating lever 28 such as illustrated in FIG. 23. The screw on knob 40 has proven very durable and serviceable. However, as stated above, this type of knob 40 requires that the insert 44 be precisely positioned and accurately secured inside the knob body 42 and that the end of the actuating lever 28 to which the knob will be attached must have a precisely machined male screw portion. Thus, while being both durable and serviceable, the screw on knob 40 has proven to be extremely expensive to manufacture and assemble due to the multiple components and the precise machining required during manufacture.

While three particular knobs 22, 24, 26 are specifically shown, it should be understood that these particular knobs were chosen for illustrative purposes only and that the underlying concepts of the present invention of which these knobs are merely representative thereof are the true invention. In order to accomplish a particular function, each of the knobs 22, 24, 26, attached to the various actuating levers has a slightly different external configuration and component design, but each knob incorporates all features of the present invention therein.

As specifically shown in FIGS. 3–6 and 7–10, the speed control knob 22 consists of a knob body 50 having a cavity 52 formed therein. The shape of the cavity 52 is dependent upon the shape of the actuating lever 28 (see FIG. 23) to which the specific control knob 22, 24, 26 will be attached. As shown in FIGS. 4, 6, 8 and 10, the internal surface of the cavity 52, may have a plurality of knife edge members 54 formed thereon. These knifed edge members 54 are preferably used to insure a tight fit between the knob 22, 24, 26 and the actuating lever 28 by reducing the cavity size to less than the size of the received actuating lever 28. Thus, when the knob 22, 24, 26 is assembled to the actuating lever 28, the knife edges 54 are crushed thereby allowing the lever 28 to be securely gripped by the individual knob. This feature of the knob construction reduces the tolerances required in the manufacture of both the knob and the lever.

Figure 4:
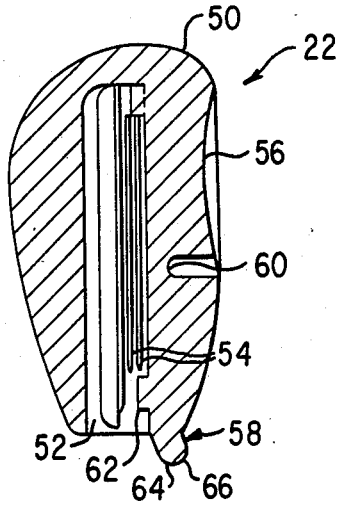
FIG. 4 is a sectional view illustrating the preferred embodiment of the speed control knob of FIG. 3.
Figure 5:
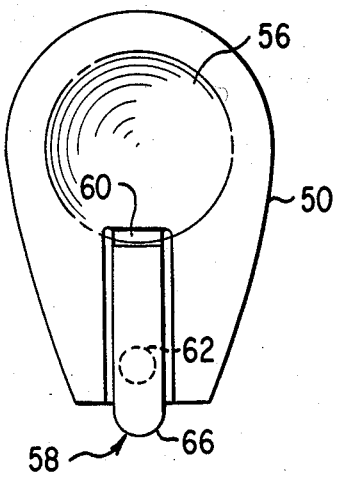
FIG. 5 is a side view of the preferred embodiment of knob of FIGS. 3 and 4 taken opposite to the view of FIG. 3.
Figure 6:
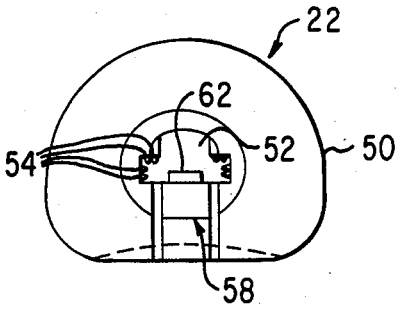
FIG. 6 is a bottom view of the knob of FIGS. 3–5.
Figure 7:
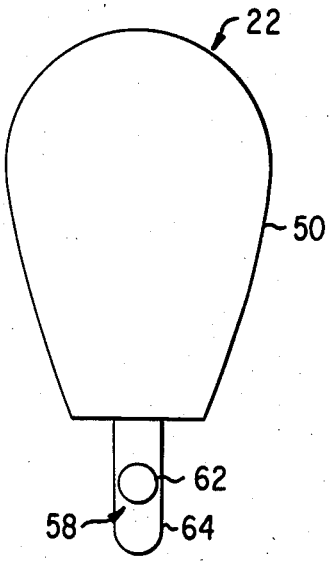
FIG. 7 is a side view of an alternate embodiment of the speed control knob of FIGS. 3–6.
Figure 8:
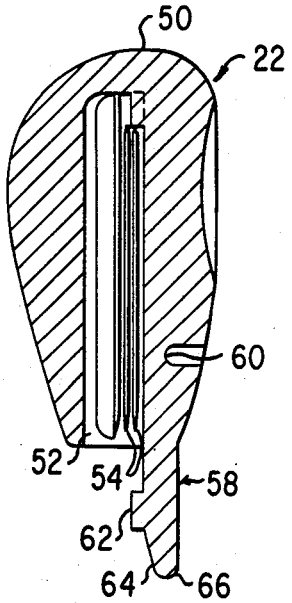
FIG. 8 is a sectional view of the knob of FIG. 7.
Figure 9:
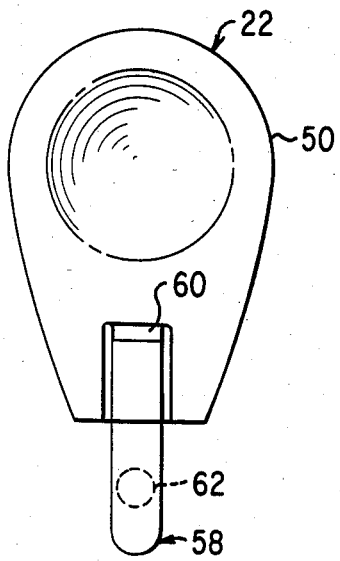
FIG. 9 is a side view of the knob of FIGS. 7 and 8 taken opposite to the view of FIG. 7.
Figure 10:
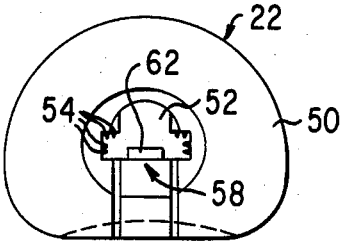
FIG. 10 is a bottom view of the knob of FIGS. 7 through 9.
Figure 11:
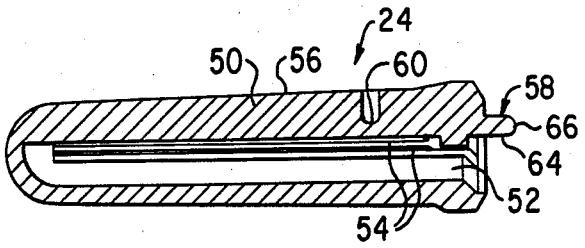
FIG. 11 is a sectional view of the preferred embodiment of a mower adjusting knob of the present invention.
Figure 12:
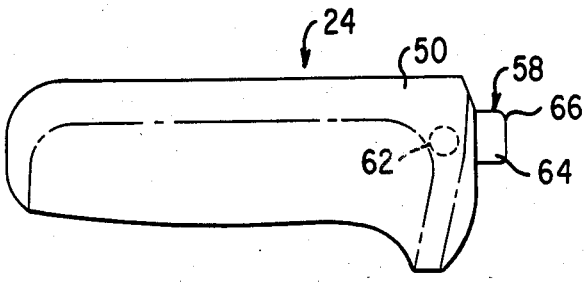
FIG. 12 is a side view of the preferred embodiment of the mower adjusting knob of FIG. 11.
Figure 13:
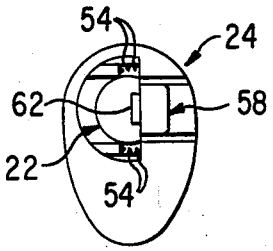
FIG. 13 is a bottom view of the preferred embodiment of the mower adjusting knob of FIGS. 11 and 12.
Figure 14:
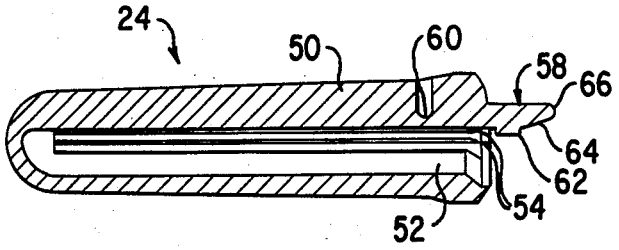
FIG. 14 is a sectional view of an alternate embodiment of the mower adjusting knob of FIGS. 11–13.
Figure 15:
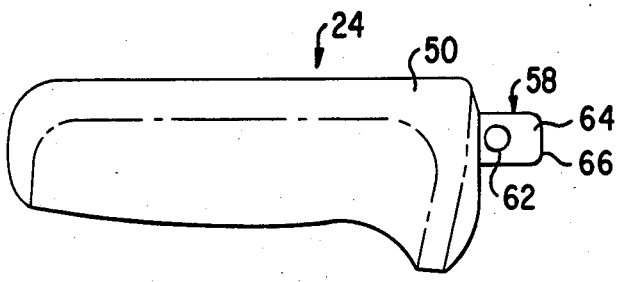
FIG. 15 is a side view of the alternate embodiment of FIG. 14.
Figure 16:
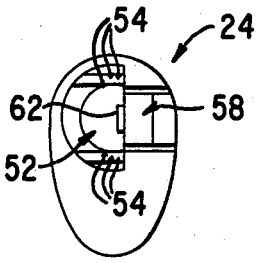
FIG. 16 is a bottom view of the alternate embodiment of the knob of FIGS. 14 and 15.
Figure 17:
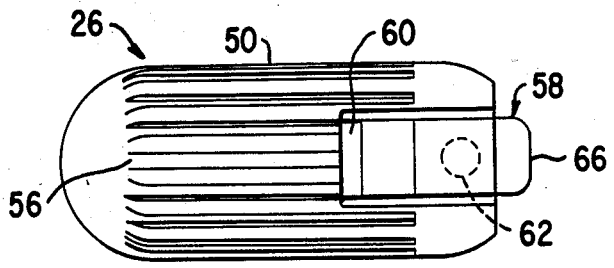
FIG. 17 is a side view of the preferred embodiment of a PTO control knob of the present invention.
Figure 18:
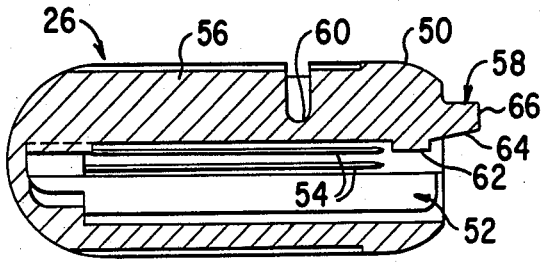
FIG. 18 is a cross sectional view of the preferred embodiment of the PTO control knob of FIG. 17.
Figure 19:
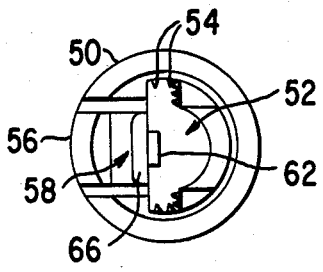
FIG. 19 is a bottom view of the preferred embodiment of the PTO control knob of FIGS. 17 and 18.
Figure 20:
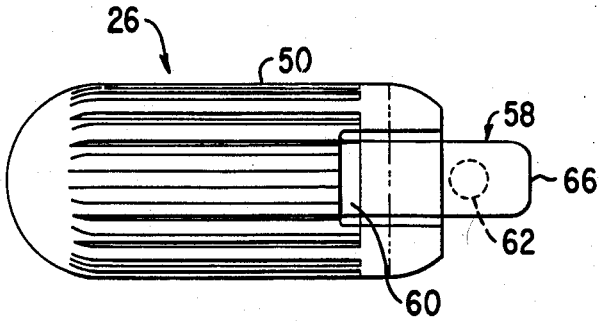
FIG. 20 is a side view of the alternate embodiment of the PTO control knob of FIGS. 17–19.
Figure 21:
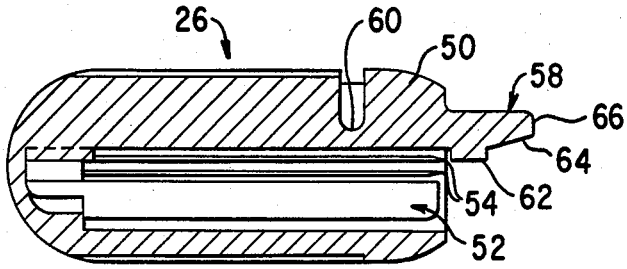
FIG. 21 is a cross sectional view of the alternate embodiment of the knob of FIG. 18.
Figure 22:
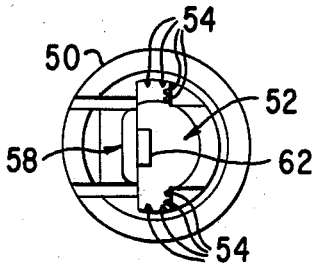
FIG. 22 is a bottom view of the knob of FIGS. 20 and 21.

One critical feature of the present invention and the one which allows the present invention to significantly reduce the manufacturing costs of the knob 22, 24, 26 while maintaining an appropriate and acceptable level of serviceability and reliability, is the resilient connection of an extension 58 to the knob body 50. As shown in FIGS. 4 and 5, the preferred point of connection of the extension 58 to the knob body 50 is approximately the mid point 60 of the knob body side surface 56. As a result of this preferred location, the end point 66 of the extension 68 barely projects beyond the entrance to the cavity 52.

While the speed control knob 22 is shown having the connection approximately at the mid point on surface 56, it should be understood that the connection points 60 can vary depending upon the relative lengths of the knob's bodies 50. However, in each of the other various preferred knob 24, 26 constructions, the end point 66 should project a relatively small distance below the entrance to the cavity 52.

In order to secure the knob to the lever, the extension 58 has a projection 62 formed thereon. The projection 62 is designed to mate with a corresponding mating portion 30 formed in the actuating lever 28. In order to positively attach the control knob 22, 24, 26 to the actuating lever 28, the extension 58 is connected to the body 50 such that the projection 62 is resiliently biased toward the cavity 52.

Since the extension 58 is resiliently biased toward the cavity 52 and thus toward the external surface of the actuating lever 28 when positioned in a cavity 52, means for disengaging the projection 62 from the mating portion 30 must be provided. As shown in FIGS. 3–5 and 7–9, a tapered portion 64 is formed on the extension 58 at a position between the end 66 of the extension 58 most remote the body 50 and extending from that end toward the projection 62.

While only the speed control knob 22 has been discussed in detail, it should be noted that knobs 24, 26, as illustrated, incorporate the same basic structural features as knob 22, but differ only in relative size and shape. Thus, a detailed discussion of each knob appears unnecessary.

It is preferred to manufacture the knobs 22, 24, 26 of the present invention by injection molding. This method of manufacture allows the extension 58 to be formed integrally with the knob body 50, although it should be understood that other methods for connecting the extension 58 to the body 50 could be utilized, and for the cavity 52 to be precisely formed inside the body 50 simultaneously therewith. Since injection molding lends itself to precise formation of the cavity 52, the projection 62 and the tapered portion 64 on the extension 58, once the individual knob 22, 24, 26 is removed from the mold, no further manufacturing steps need be taken.

The preferred method of manufacture for the knob of the present invention consists of the manufacture of at least one mold for each specific knob required. This mold will incorporate means therein for forming the knob body 50 having a cavity 52 which may include optional knife edges 54 formed therein, and extension 58 with a projection 62 formed thereon, including means for biasing the extension 58 toward the cavity 52, and a tapered portion 64 formed on the extension 58 at the end thereof most remote from the extension connection to the body 50 and proximate the projection 62.

In order to assemble the control knob 22, 24, 26 to the actuating lever 28, an assembler would align the end of the actuating lever 28 with the cavity 52 and slide the knob onto the lever 28 until the extension 62 engages the mating portion 30, preferably an aperture, formed in the lever 28. At this point, the control knob 22, 24, 26 would be securely, yet easily detachably assembled on the actuating lever 28.

In order to remove the control knob 22, 24, 26 from the actuating lever 28, an operator would grasp the end of the extension 58 by utilizing tapered portion 64 and pulling the extension 58 away from the surface of the actuating lever 28 thereby disengaging projection 62 from mating portion 30 while simultaneously grasping knob body 50 and pulling the knob body 50 away from the end of the actuating lever 28.

Therefore, it appears from the above description that all objects of the present invention have been met.

While the method and article herein described constitute preferred embodiments of the invention, it is to be understood that the invention is not limited to this precise method and article, and that changes can be made therein without departing from the scope of the invention which is defined in the appended claims.

What is claimed is:

1. A knob for mounting on a lever having first mating means, said knob comprising:

a knob body;

means, operatively associated with said body, for receiving said lever; and resilient means, integrally formed with said body, for operatively connecting said knob to said lever, said resilient means comprising an extension, said extension having second mating means operatively connected thereto, said second mating means being connected to the side of said extension most proximate said lever receiving means, said extension having means for selectively operatively engaging and disengaging said first and said second mating means, said selective engaging and disengaging means being a surface operatively positioned on the side of said extension most proximate said lever receiving means and at the end of said extension most remote from its connector to said knob body.

2. The knob of claim 1 wherein said lever receiving means further comprises:

a cavity formed in said body.

3. The knob of claim 2 wherein said cavity further comprises:

a plurality of knife edges formed on the internal surface of said cavity for engaging said lever.

4. The knob assembly of claim 1 wherein said second mating means further comprises:

a projection, operatively connected to said extension, for engaging said first mating means such that said knob is securely connected to said lever.

5. The knob of claim 1 wherein said projection selectively engages an opening operatively formed on said lever thereby allowing said knob to be easily removed from said lever.

6. The knob of claim 1 wherein said selective engagement and disengagement means comprises:

a tapered surface formed on the end of said extension most remote from the point where said extension is connected to said body and on the side of said extension most proximite said lever receiving means.

7. A knob for mounting on a lever having first mating means, said knob comprising:

a knob body;

a cavity formed in said body;

an extension operatively connected to said body and being biased toward said cavity;

a second mating means, operatively connected to said extension, for engaging said first mating means; and a tapered surface, operatively positioned on the end of said extension most remote from the connection between said extension and said body, for selectively assembling to and disassembling said knob from said lever, said tapered surface being formed on the side of said extension which contacts said lever when said knob is secured to said lever.

8. The knob of claim 7 further comprising:

a plurality of knife edges formed in said cavity for engaging said lever.

9. The knob of claim 8 wherein a first mating means comprises a projection formed on said lever.

10. The knob of claim 8 wherein said first mating means further comprises a projection formed on said extension.

11. A knob assembly comprising:

a knob body having an elongated cavity operatively formed therein, said cavity extending from a inward end thereof;

a lever having an end for receiving said knob cavity and first mating means for securing said knob body to said lever; and an extension, operatively connected to said knob body, having second mating means for cooperating with said first mating means, said extension having means for operating said extension between a first position wherein said extension is in press fit engagement with said lever and a second position wherein said extension is raised out of engagement with said lever, said operating means being a surface positioned on the side of said extension which is in press fit engagement with said lever.

12. The knob assembly of claim 7 wherein said extension operating means further comprises:

a tapered surface extending beyond the inward end of said knob body.

13. The knob assembly of claim 1 wherein said tapered surface diverges outward from the axis of said knob body such that lifting of said extension is facilitated thereby.

14. The knob of claim 13 wherein said second mating means further comprises:

a projection operatively formed on the side of said extension in press fit engagement with said lever.

15. The knob of claim 1 wherein said second mating means further comprises:

an opening operatively formed on the side of said extension in press fit engagement with said lever.

16. The knob of claim 1 wherein said elongated cavity has resilient splines formed on the internal walls thereof, said splines being deflectable by said lever means.

17. A knob for mounting on a lever having a first mating means, said knob comprising:

a knob body;

an elongated cavity formed in said body;

an extension operatively connected to said body such that extension is biased toward said cavity;

a second mating means operatively positioned on said extension for engaging said first mating means; and a tapered surface, operatively formed on the end of said extension most remote from the point of connection between said extension and said knob body, said tapered surface being formed on the side of said extension most proximate said cavity formed in said knob body.

18. The knob of claim 17 wherein said first mating means comprises:

an opening formed in said lever.

19. The knob of claim 18 wherein said second mating means comprises:

a projection formed on said extension.

20. The knob of claim 17 further comprising a plurality of resilient splines formed on the internal walls of said cavity, said splines being deflectable by said lever.

21. The knob of claim 17 wherein said first mating means comprises a projection formed on said lever.

22. The knob of claim 21 wherein said second mating means comprises an opening formed in said extension.

* * * * *

UNITED STATES PATENT AND TRADEMARK OFFICE

CERTIFICATE OF CORRECTION

PATENT NO. : 4,783,884

DATED : 15 November 1988

INVENTOR(S) : David K. Stricker et al.

It is certified that error appears in the above-identified patent and that said Letters Patent is hereby corrected as shown below:

Column 5, line 60, delete "1" and insert therefor -- 4 -- .
Column 6, line 21, delete "8" and insert therefor -- 7 --; line 23, delete "8" and insert therefor -- 7 --; line 43, delete "7" and insert therefor -- 11 -- ; line 47, delete "1" and insert therefor -- 12 -- ; line 55, delete "1" and insert -- 13 -- ; line 59, delete "1" and insert therefor -- 13 -- .

Signed and Sealed this

Twelfth Day of December, 1989

*Attest:*

JEFFREY M. SAMUELS

*Attesting Officer* *Acting Commissioner of Patents and Trademarks*